United States Patent [19]

Shaub et al.

[11] 4,130,494

[45] Dec. 19, 1978

[54] SYNTHETIC LUBRICANT COMPOSITION

[75] Inventors: Harold Shaub, New Providence; Stephen J. Metro, Scotch Plains, both of N.J.

[73] Assignee: Exxon Research & Engineering Co., Florham Park, N.J.

[21] Appl. No.: 875,633

[22] Filed: Feb. 6, 1978

Related U.S. Application Data

[63] Continuation-in-part of Ser. No. 683,266, May 5, 1976, abandoned.

[51] Int. Cl.[2] ..... C10M 1/44; C10M 3/38; C10M 5/24; C10M 7/24

[52] U.S. Cl. ..... 252/32.5; 252/33

[58] Field of Search ..... 252/33, 32.5

[56] References Cited

U.S. PATENT DOCUMENTS

| | | | |
|---|---|---|---|
| 2,777,819 | 1/1957 | Williams et al. | 252/32.5 |
| 3,075,005 | 1/1963 | Carden et al. | 252/33 |
| 3,203,895 | 8/1965 | Latos et al. | 252/32.5 |
| 3,247,109 | 4/1966 | Benoit | 252/32.5 |
| 3,340,188 | 9/1967 | Barrett | 252/33 |
| 3,425,953 | 2/1969 | Corvan et al. | 252/33 |
| 3,431,265 | 3/1969 | Wakeman et al. | 252/33 |
| 3,567,636 | 3/1971 | Katzenstein | 252/32.5 |
| 3,720,612 | 3/1973 | Bosniack et al. | 252/32.5 |
| 3,859,218 | 1/1975 | Jervis et al. | 252/32.5 |
| 3,914,179 | 10/1975 | Byford et al. | 252/32.5 |

FOREIGN PATENT DOCUMENTS

| | | | |
|---|---|---|---|
| 806851 | 2/1974 | Belgium | 252/32.5 |
| 1440129 | 6/1976 | United Kingdom | 252/32.5 |

*Primary Examiner*—Irving Vaughn

*Attorney, Agent, or Firm*—Eugene Zagarella, Jr.

[57] ABSTRACT

Synthetic lubricating oil compositions comprising a unique combination of additives. A variety of esters known in the prior art to be useful in synthetic lubricating compositions for aircraft engines may be used in the compositions of this invention. Esters derived from neopentyl polyols are, however, preferred and best results are obtained when the esters are derived from a mixture of such polyols. The additive combination comprises, essentially, an oil-soluble organic amine salt of a phosphate ester and a neutral oil-soluble organosulfonic acid ammonium salt. The additive combination is particularly effective in increasing the load carrying ability of lubricating oils, which especially is critical in applications such as turbine engines.

22 Claims, No Drawings

SYNTHETIC LUBRICANT COMPOSITION

CROSS REFERENCE TO RELATED APPLICATIONS

This application is a continuation-in-part of copending application U.S. Ser. No. 683,266, filed May 5, 1976 abandoned.

BACKGROUND OF THE INVENTION

This invention relates to a lubricating oil composition. More particularly, this invention relates to a synthetic lubricating oil composition. Still more particularly, this invention relates to a synthetic, ester lubricating oil composition.

Synthetic lubricating oils comprising simple esters, complex esters and/or polyesters, as base oil stocks are well known in the prior art. In fact, due to the unique physical characteristics of these materials, the synthetic, ester lubricating oils have been widely used in those areas wherein oils are subjected to extreme temperature variations, such as in aircraft engines and the like. These ester base oils do not, however, inherently exhibit high load carrying ability and cannot be used, without modification, where a high degree of lubricity is required. Also, the synthetic ester oil compositions are subject to oxidative degradation and cannot be used, without further modification, for long periods under oxidizing conditions. Moreover, most, if not all, synthetic ester lubricating oils, which have been modified through the use of load augmenting additives, are not compatible with silicone elastomers commonly used in jet engines and accessories and, therefore, cannot be used in contact with such materials, at least at elevated temperatures, for long periods without further modification thereof. Further, the synthetic ester lubricating oil compositions tend to be corrosive and will, indeed, attach some metals used in turbo-jet and turbo-prop engines, such as copper and magnesium, when used in contact therewith without the use of further additives.

It is also well known that any one of the aforementioned deficiencies of the base oils can be avoided through the proper selection of one or more additives known to be effective in overcoming any particular deficiency. In fact, it is often possible through the proper selection and combination of additives to overcome several known deficiencies of the ester base oil stocks. It has not, however, heretofore been possible to overcome all of these specified deficiencies in a single formulation or even to obtain a satisfactory balance which would, then, permit a relatively broad range of application for a single formulation. As a result, it has, heretofore, been necessary to formulate different compositions for different applications and in some cases, at least, these compositions are only marginally acceptable for the designed application since they do not exhibit the optimum balance of properties required therefor.

One reason for the aforementioned inability to produce a single lubricating composition having a relatively good balance of properties is that as to certain deficiencies, the various additives must perform competing functions and when such additives are blended one or more will dominate in performance at the expense of the remaining additives. Another reason for this inability is that, in some cases at least, the various additives are chemically incompatible and when such additives are blended chemical reaction and/or decomposition result in loss of additive function and in some cases, at least, will result in engine deposits. In this regard, it is well known that such deposits can cause serious operating problems ranging from seal leaks to engine failures. Such deposits are therefore, undesirable and should be avoided if at all possible.

In light of the foregoing, it is believed that the need for a synthetic lubricating oil composition having an improved balance of properties is readily apparent. It is also believed that the need for such a synthetic lubricating oil composition which can be used without undesirable engine deposits or at least with a minimum of such deposits is also readily apparent.

SUMMARY OF THE INVENTION

It has now been found that the foregoing and other deficiencies of the prior art synthetic lubricating oil compositions can be avoided with the synthetic ester lubricating oil compositions of this invention and improved load carrying capacity can be provided thereby. It is, therefore, an object of this invention to provide a synthetic, ester lubricating oil composition. It is another object of this invention to provide such a composition exhibiting an improved balance in load carrying ability and silicone elastomer compatibility. It is still another object of this invention to provide such a composition which can be used under extreme temperature conditions with a reduced amount of deposits. The foregoing and other objects and advantages will become apparent from the disclosure set forth hereinafter.

In accordance with the present invention, the foregoing and other objects and advantages are accomplished with a synthetic lubricating oil composition comprising a base oil consisting of one or more carboxylic acid esters and a unique combination of additives. The additive combination comprises, essentially, an organoamine salt of an alkyl phosphate ester, and an organo sulfonic acid ammonium salt. The additive combination will, generally, also comprise an oxidation inhibitor such as a di(alkylphenyl) amine, a phenyl $\alpha$ or $\beta$ naphthylamine, an alkylphenyl $\alpha$ or $\beta$-naphthylamine or a mixture of any of these amines. The synthetic lubricating oil composition may, and generally will, also contain other additives which are compatible with the aforementioned additives. Such other additives may include a dispersant, an alkylphenyl ester of phosphoric acid, such as the tri (alkylphenyl) ester, a hydrolytic stabilizer and/or a storage stabilizer. It is, of course, essential that all additives used be oil soluble and compatible at the concentrations actually employed.

DETAILED DESCRIPTION OF THE INVENTION

In general, a variety of the esters known in the prior art to be useful as lubricating oil base stocks and particularly as lubricants for aircraft engines may be used in the lubricating oil compositions of this invention. These include the simple esters, the complex esters and the polyesters.

As used herein, the term "simple ester" shall mean or include esters derived from monohydric aliphatic alcohols and monobasic aliphatic carboxylic acids and esters derived from monohydric aliphatic alcohols and dibasic aliphatic acids. Generally, the monohydric aliphatic alcohols used to prepare these esters will have from 1 to 18 carbon atoms in the molecule and preferably from 4 to 13 carbon atoms while the monobasic aliphatic acids will have from 2 to 22 carbon atoms in the molecule and preferably 4 to 12 carbon atoms. The dibasic aliphatic acids, on the other hand, will generally have from 2 to 25 carbon atoms in the molecule and preferably 4 to 14 carbon atoms. As is well known in the art, both the acid portion and the alcohol portion of the ester may be either straight or branched chained. More commonly, however, straight-chained, aliphatic carboxylic acids will be used in combination with branched-chained, aliphatic alcohols.

The term "complex ester", as used herein shall mean an ester formed from the reaction of two or more of the following compounds:

1. Monohydric aliphatic alcohols
2. Monobasic aliphatic acids
3. Aliphatic glycols or polyglycols
4. Polyhydric aliphatic alcohols
5. Dibasic aliphatic acids
6. Polybasic aliphatic acids where at least one polyfunctional alcohol and at least one polyfunctional acid are employed. This definition includes esters of the following types:

I. Glycol centered complex esters, i.e. esters having a chain exemplified as-monohydric alcohol-dibasic acid (glycol-dibasic acid)$_x$-monohydric alcohol;

II. Dibasic acid centered complex esters, i.e. esters having a chain structure which may be exemplified as monobasic acid-glycol-(dibasic acid glycol)$_x$-monobasic acid; and III. Alcohol acid terminated complex esters, i.e. esters having a chain structure which may be exemplified as monobasic acid-(glycol-dibasic acid)$_x$-monohydric alcohol; wherein x is a number greater than 0, preferably about 1 to 6.

Preparation of complex esters are disclosed in U.S. Pat. Nos. 2,575,195, 2,575,196 and 3,016,353. Generally, the monohydric aliphatic alcohols used in the preparation of these esters will have from 1 to 18 preferably 4 to 13 carbon atoms in the molecule and the same may have either a straight or branched chained structure. The polyhydric aliphatic alcohols which may be used to prepare esters of this type generally will have from 4 to 25 and preferably from 5 to 20 carbon atoms per molecule and the same may contain ether linkages. The aliphatic glycols or polyglycols may contain from 2 to 70 and preferably from 2 to 18 carbon atoms per molecule and also may contain ether linkages. The alcohols should, however, be free of all atoms other than carbon, hydrogen and oxygen. Monobasic aliphatic acids which may be used to prepare these esters will, generally, contain from 2 to 22 and preferably from 4 to 12 carbon atoms and these materials too may have either straight or branched chained structures. The dibasic acids which may be used in the preparation of the complex esters will have from 2 to 25 and preferably 4 to 14 carbon atoms in the molecule. The polybasic aliphatic acids will contain from 3 to 30 carbon atoms and preferably 4 to 14 carbon atoms in the molecule.

As used herein, the term "polyester" shall mean a fully esterified ester, or at least a substantially fully esterified ester, obtained with a polyhydric aliphatic alcohol having at least two hydroxyl groups therein. Generally, these alcohols will contain from 2 to 10 hydroxyl groups per molecule and from 4 to 25 and preferably 5 to 20 carbon atoms therein. The polyesters including esters derived from the hindered, neopentyl alcohols such as neopentyl glycol, trimethylolethane, trimethylolpropane, higher trimethylolalkanes, pentaerythritol, dipentaerythritol, tripentaerythritol and higher pentaerythritols or other ethers and esters prepared with these alcohols are preferred in the lubricating oil compositions of the present invention since they will withstand higher temperatures than the aforedescribed simple and complex esters. Generally, the polyhydric aliphatic alcohols will be esterified with a normal or branched chain monobasic aliphatic acid having from 2 to 22 and preferably from 4 to 12 carbon atoms in the molecule or with mixtures of such acids. Particularly preferred polyesters are those made by esterifying a polyol having at least 3 hydroxyl groups with a monocarboxylic alkanoic acid having 5 to 10 carbon atoms and this includes esters made from polyols chosen from the groups consisting of tri-hydroxy polyols, tetrahydroxy polyols and dimers of said tetrahydroxy polyols. Esters of this type as well as of other types useful in the compositions of this invention are described throughout the literature and in such U.S. Pat. Nos.: 2,015,088; 2,723,286; 2,743,234; 2,575,196; 3,218,256 and 3,360,465. Moreover, polyesters of the type useful in the synthetic lubricating oil compositions of this invention are available commercially.

In general, the ester lubricating oil base stocks used in the compositions of this invention will have: viscosity indices of at least 100; pour points not exceeding −40° F.; boiling and/or decomposition temperatures not less than 600° F.; and flash points not less than 400° F. It will, of course, be appreciated that mixtures of any of the aforedescribed esters could be used in the compositions of this invention and as is pointed out more fully hereinafter, a particularly preferred blend is obtained by mixing esters of trimethylolpropane and pentaerythritol. It will also be appreciated that individual esters having viscosity indices below 100 and/or pour points above −40° F. can be used in such blends provided that the mixture itself has the desired properties.

As indicated, supra, the essence of the present invention resides in a unique combination of additives which may be blended into any one or more of the aforedescribed ester base oil stocks to provide a synthetic lubricating oil composition having an improved load carrying ability. More specifically, the essence of the present invention resides in the discovery that when an organo amine salt of a phosphate ester is used in combination with an organo sulfonic acid ammonium salt, with or without other compatible additives, in any of the ester base oils useful in the present invention, there is obtained a synthetic lubricating composition exhibiting a greater load carrying capacity than obtainable with either the organo sulfonic acid ammonium salt or the organo amine salt of a phosphate ester used alone.

In general, the oil soluble amine salts of phosphate esters useful in the compositions of this invention will be characterized either by the general formula:

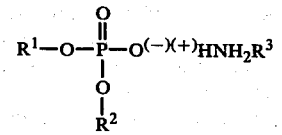

I or the general formula:

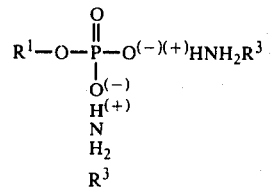

IA wherein $R^1$ is an alkyl or alkenyl group containing from 1 to 10 carbon atoms, $R^2$ is either the same or a different alkyl or alkenyl group containing from 1 to 10 carbon atoms and $R^3$ is either hydrogen (H), an alkyl or alkenyl group containing from 1 to 22 carbon atoms or an arylalkyl group characterized by the general formula

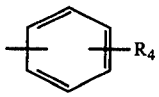

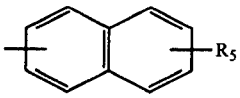

wherein $R_4$ is hydrogen or alkyl or alkenyl group containing from 1 to 12 carbon atoms and $R_5$ is hydrogen or an alkyl or alkenyl group containing from 1 to 6 carbon atoms. At this point, it should be noted that when $R_4$ and $R_5$ are alkyl or alkenyl, the same may be bonded to any of the carbon atoms in the aromatic structure which are not bonded to the amino nitrogen. It will, of course, be appreciated that a single salt as well as mixtures of such salts within the scope of any one of the generic formulae can be used. In either case, the total amount of such salts actually used will, generally, be within the range from about 0.01 to about 10.0 and preferably from about 0.01 to about 0.5 parts by weight per 100 parts by weight of base oil stock.

The amine salts useful in the synthetic lubricating oil compositions of this invention may be prepared in accordance with techniques well known in the prior art. For this reason, no attempt will be made herein to detail the several procedures which might be used. Nonetheless, it should be noted that these salts may be prepared, simply, by contacting a suitable mono- or diester of phosphoric acid or mixtures of either one or both of these general type esters with a suitable aromatic amine or with a mixture of such amines. This may be accomplished in a suitable solvent and in certain cases may be accomplished in an ester base oil stock. The temperature at which the contacting is accomplished is, of course, not critical and any suitable temperature may be used. Temperatures between about 75° and 150° F. are, however, most satisfactory. Generally, the contacting will be made with stoichiometric quantities of both materials such that there will not be a significant excess of either after the salt formation has been completed. In this regard, it should be noted that when the mono-ester is used 2 moles of the amine will be required while, when the diester is employed only 1 mole of the amine will be required. When mixtures of the mono- and diesters are used, the amount of amine required will be between these two extremes and the quantity required will be proportionate to the molar ratio of diester to monoester in the mixture. In any case, the amount required can be determined and/or controlled by following the pH during the amine addition.

The organo sulfonic acid ammonium salts which can be used in the synthetic lubricating oil compositions of this invention contain an organo sulfonate group and an ammonium group. The organo sulfonate group in the additive can be obtained from a sulfonic acid or a corresponding metal sulfonate salt of the sulfonic acid. Accordingly, when used in the present specification it is understood that the term "organosulfonic acid ammonium salt" refers to a salt prepared from an organosulfonic acid or organometal sulfonate.

The sulfonic acids used in preparing the additives of the present invention have the general formula $RSO_3H$ where R is a $C_1$ to $C_{18}$ hydrocarbyl group, and preferably a $C_1$ to $C_{12}$ hydrocarbyl group. The hydrocarbyl group can be an aliphatic or alicyclic group, such as, an alkyl group, a cycloalkyl group, an aromatic group, a 1 or 2 naphthyl group, an anthryl group, or a phenanthryl group. The alkyl groups can be straight chained, or branched and preferably contain from 1 to 12 carbon atoms. Exemplary of alkyl groups suitable for use in the present invention are methyl, ethyl, propyl, butyl, heptyl, hexyl and the like. The cycloalkyl groups preferably contain from $C_5$ to $C_{10}$ carbon atoms and exemplary of typical cycloalkyl groups, are the cyclohexyl group, the cyclopentyl group and the like. Exemplary of suitable aromatic groups are the benzene (phenyl) group, ortho-, meta-, or paratoluene groups, the dodecyl benzene group, the naphthyl and anthranil group and the like. The aromatic groups can be substituted by from one to four alkyl groups where each alkyl group contains from 1 to 12 carbon atoms and the total number of carbon atoms is between $C_7$ to $C_{18}$.

The sulfonic acids used in the present invention can be made by means well known to the art such as sulfonation of hydrocarbons. See, for example, Kirk-Othmer Encyclopedia of Chemical Technology, Second Edition, Volume 19, pp. 311–319. The sulfonic acids generally will have molecular weights of about 112 to about 342 and can be either pure compounds or mixtures prepared by sulfonating various petroleum fractions.

Representative of the organo sulfonic acids that can be used in preparing the additives employed in the present invention are p-toluene sulfonic acid, 2-naphthalene sulfonic acid, dodecylbenzene sulfonic acid, DL-camphor sulfonic acid, and methane sulfonic acid. Further examples of these sulfonic acids include alkylated benzenes or naphthalenes, having 1 to 4 alkyl groups of 8 to 20 carbons each, such as: dinonyl benzene sulfonic acid, trinonyl benzene sulfonic acid, didodecyl benzene sulfonic acid, di-cetyl naphthalene sulfonic acid, diisononyl benzyl sulfonic acid, wax substituted benzene sulfonic acids, and the like. Petroleum sulfonic acids may also be used, such as mahogany sulfonic acid, white oil sulfonic acid, mineral oil sulfonic acid, petrolatum sulfonic acid, and the like. The organo sulfonate group can also be obtained from the corresponding salts of such acids such as the sodium salts of such acids.

In accordance with the invention, the organo sulfonic acid ammonium salts contain an ammonium group which can be obtained from essentially any nitrogen base including primary, secondary or tertiary amines or the organo sulfonic acid ammonium salt may be the acid addition salts or quaternary ammonium salts thereof. Mixtures of such amines or of such salts can also be used. The ammonium group of the nitrogen base used in the preparation of the additive of this invention has the general formula $$NR^1R^2R^3R_x^4$$

where x is 0 when the nitrogen base is a primary, secondary or tertiary amine or acid addition salt of such an amine, x is 1 when it is a quaternary ammonium salt, and $R^1$, $R^2$, $R^3$, and $R^4$ are each hydrogen or $C_1$-$C_{56}$, preferably $C_1$-$C_{28}$ hydrocarbyl groups, provided at least one of $R^1$, $R^2$, $R^3$ or $R^4$ is a $C_1$–$C_{28}$ hydrocarbyl group.

The nitrogen bases which can be employed to produce the ammonium addition salts used in the present invention can have aliphatic or alicyclic hydrocarbyl radicals such as alkyl, aryl, alkaryl, or aralkyl radicals. The alkyl radicals or the alkyl portion of the radicals are either of straight chain or branched chain character and contain from 1 to 28 carbon atoms per hydrocarbyl radical. Representative alkyl radicals include methyl; ethyl; propyl; butyl; hexyl; decyl; tertiary butyl methyl; 1,1-decyl; amyl; lauryl; myristyl; cetyl (palmityl); stearyl; arachidyl; behenyl; lignoceryl; and cerotyl. Aromatic or alkyl aromatic radicals suitable for use include phenyl, naphthyl, o, m, or p, -toluel, a $C_1$ to $C_{22}$ alkyl phenyl or naphthyl, benzyl, and dibenzyl as well as the corresponding phenethyl radicals. Suitable cycloaliphatic radicals include cyclohexyl, cyclopentylmethyl, cyclopentyl and the like. Methyl, phenylamine; butyl, tolyl amine, o, m, or p, -dodecylphenylamine, o, m, or p, -nonylphenylamine, and the like are examples of useful mixed alkyl, aryl and alkaryl amines.

Many of the nitrogen bases are commercially available as mixtures, such as amines derived from $C_{12}$ oxo alcohol bottoms. For example, a mixed branched chain isomeric 1,1-dimethyl $C_{12}$–$C_{14}$ primary aliphatic amine composition is sold under the tradename "Primene 81-R" and a mixed branched chain isomeric 1,1-dimethyl $C_{18}$–$C_{22}$ primary amine composition is sold under the tradename "Primene JMT". Many of the amine mixtures sold under the "Armeen" trademark likewise suitable compositions to be employed in producing the sulfonic acid ammonium salts. These amines contain alkyl radicals ranging from $C_{12}$ through $C_{18}$ or mixtures thereof which are derived from fatty acids. The corresponding $C_2$–$C_{20}$ polyalkylene polyamines are also useful.

As used in this description and accompanying claims, the term "hydrocarbyl" is intended to include not only hydrocarbon radicals of aliphatic or alicyclic character but also includes the simple derivatives thereof such as the hydroxy derivative. Thus, hydroxy amines can be used in the preparation of the additives. Such hydroxy amines can be conveniently prepared by reacting a simple amine with an alkylene oxide. For example dipropylamine can be reacted with a long chain epoxide such as

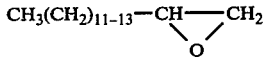

to prepare a tertiary amine alcohol.

Representative of suitable amines and ammonium salts which can be used are the following: N-butylamine; decylamine, phenyl nonylamine; tertiary butylamine; tri-n-butylamine; triethylamine; N,N-di-n-propyl-2-(hydroxy) pentadecylamine; N,N-di-n-butyl-2-(lauroyloxy) pentadecyl-amine, octylamine, nonylamine; 2-ethylhexylamine; hexylamine; dimethylhexylamine; diethylheptylamine; dibutylamylamine; dimethyloctylamine; methyloctylamine; ethylhexylamine; dioctylamine; diamylcyclohexylamine; dicyclohexylamine; benzyldihexylamine; phenethyloctylamine; and the like, as well as water soluble acid addition salts of such amines with acids such as hydrochloric, sulfuric, acetic, citric, tartaric, hydrobromic and phosphoric. Quaternary ammonium salts are also operative, including trimethylhexylammonium chloride, triethyloctylammonium bromide, dimethyldicyclohexylammonium chloride and benzyldimethylhexylammonium chloride. Such salts are obtained by reacting tertiary amines of the type disclosed above with aliphatic or arylaliphatic halides. Among such halides are methyl chloride, ethylbromide, propyl iodide, dimethyl sulfate, methyl benzenesulfonate, benzyl chloride, phenethyl bromide and the like.

The formation of the amine addition salts of acids such as sulfonic acid can be easily carried out by means well known to those of ordinary skill in the art. Generally, the reaction can be carried out at room temperature, but because of the relatively high molecular weight of some of the amines and of some of the sulfonic acids that are solids at normal or atmospheric temperatures, these compounds may be reacted under elevated temperatures of from about 25° C. to as high as 100° C. Alternatively, the amines and sulfonic acid can be reacted as solutions at ambient temperatures in organic solvents to form the acid addition salts. Suitable solvents are the hydrocarbon solvents such as naphtha, benzene, toluene, pentane, hexane, petroleum ether, or the lower alcohols such as ethanol, isopropanol, butanol, the ester base oils, amyl acetate and other conventional carboxylic acid ester solvents, and the like. The amine addition salts of the sulfonic acids can also be formed in situ by the separate additions of the two reactants directly to the base oil.

Sufficient amounts of the primary, secondary or tertiary amines, or mixtures thereof, may be employed so as to give a pH of the reaction mixture of slightly less than 7.0, i.e. 6.5, but preferably a pH of at least 7.0 is used in order to insure that for the most part the sulfonic acids are neutralized. Usually, sufficient amine is incorporated into the reaction to give a final pH of about 7.5. If less amine is used, the reaction mixture will comprise a mixture of unreacted sulfonic acids and the amine addition salt of the sulfonic acids. If more than the amount of amine recited to give a pH of 7.0–7.5 is used then of course, the reacted mixture will comprise a mixture of free amine and the amine acid addition salt of the sulfonic acid. After the required amount of amine has been added to the sulfonic acid reaction mixture, and thorough agitation has insured a completion of the reaction (neutralization) the solvent, if used and not an ester base oil, may be stripped from the reaction mixture while distilling the same therefrom. This conveniently is accomplished under a vacuum, i.e., 1–5 millimeters of mercury vacuum and at a temperature of from 100° to 150° C.

In preparing the sulfonic acid amine products used in the present invention, the amine and sulfonic acid are chosen so that the final product has $C_{13}$ to $C_{37}$, preferably $C_9$ to $C_{30}$ carbon atoms. If the product has less than 10 carbon atoms, it is generally found that it will not be soluble in the synthetic ester base stocks. Thus, the organo sulfonic acid ammonium containing additives must possess at least sufficient oil solubility so that the required or desired amounts thereof will be dissolved in the synthetic ester oil. Thus, a hydrocarbyl amine of a low number of carbon atoms may be used to neutralize a hydrocarbyl sulfonic acid of a high number of carbon atoms or a hydrocarbyl amine of a high number of carbon atoms may be used to neutralize a hydrocarbyl sulfonic acid of a low number of carbon atoms.

The organo sulfonic acid ammonium salts used as additives in the present invention can also be made by reacting an amine hydrochloride or similar salt with a metal sulfonate salt to precipitate, for example, a metal chloride such as sodium chloride. Such reactions often occur under milder conditions than the aforesaid direct reaction of the amine with the free sulfonic acid. In certain direct reactions between an amine and a sulfonic acid, a buffering effect is obtained resulting in a pH of about 5.5–6 instead of the desired neutral point pH of 7. Reaction between a metal sulfonate and amine acid addition salt forces the reaction toward completion and can be successfully used to obtain a neutral organosulfonic ammonium salt.

The preparation of the lubricating compositions of the present invention involves no special techniques. Generally, the lubricants are formed by adding an appropriate amount of the organo amine salt of a phosphate ester and an appropriate amount of the organosulfonic acid ammonium salt additive to the synthetic ester oil base stock and heating and stirring the composition until the additive is dissolved.

The amount of organo amine salt of a phosphate ester incorporated into the synthetic neutral ester lubricant base stock generally varies between about 0.01 and about 10.0 parts per 100 parts by weight of the base ester oil. Preferably, about 0.01 to about 0.5 parts of the additive is employed.

The amount of organosulfonic acid ammonium salt incorporated into the synthetic neutral ester lubricant base stock generally varies between about 0.01 and about 5.0 parts, per 100 parts by weight of the base ester oil. Preferably about 0.01 to about 0.5 parts of the additive is employed.

Other lubricating additives conventionally incorporated in synthetic ester lubricating oils can be added to the lubricating compositions of the present invention in amounts of 0.01 to 5.0 weight percent each, based on the total weight of the composition. Examples of such additives include, but are not limited to, viscosity index improvers, pour point depressants, corrosion inhibitors, thickeners, sludge dispersants, rust inhibitors, anti-emulsifying agents, anti-oxidants, dyes, dye stabilizers, and the like.

The following examples are given by way of illustration to further explain the principles of the invention. These examples are merely illustrative and are not to be understood as limiting the scope and underlying principles of the invention in any way. All percentages and parts referred to herein are by weight unless otherwise specifically indicated.

The following chart compares the results of Ryder Gear Load tests and the silicone elastomer compatibility of an oil with a variety of additives.

| | EXAMPLE | | | | | |
|---|---|---|---|---|---|---|
| I | | II | III | IV | V | VI |
| Base A, parts by weight | 100 | 100 | 100 | 100 | 100 | 100 |
| Neutral aromatic amine salt of phosphate ester, parts by weight | 0.04 | 0.04 | | 0.04 | 0.04 | 0.05 |
| Primary alkylamine, parts by weight | | 0.014 | | 0.014 | .014 | |
| Methane Sulfonic Acid Ammonium Salt parts by weight | | | 0.04 | 0.04 | .05 | 0.04 |
| Ryder Gear Load, lbs/in. | 3,023 | 3,263 | 3,005 | 3,814 | 4,080 | 3,990* |
| Silicone Compatibility, % Swell After 96 hours at 250° F.** | 8.4 | 8.1 | 9.9 | 8.2 | 8.9 | 7.7 |

*Estimated value obtained with simulated test
**After this test no deterioration or cracking of the rubber sample was detected.

Base stock Oil A is a tetraester of pentaerythritol with a mixture of $C_5$–$C_9$ normal alkanoic acids. The neutral aromatic amine salt of a phosphate ester was a mixture which can be represented by the following formulae:

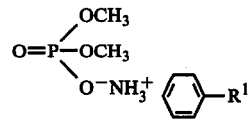

and

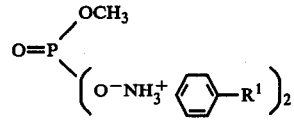

wherein $R^1$ is a mixture of $C_9$–$C_{13}$ alkyl groups. The methane sulfonic salt which was used can be represented by the formula:

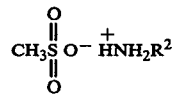

wherein $R^2$ is a mixture of $C_{12}$–$C_{14}$ alkyl groups and was the salt of the primary amine used in each formulation.

The U.S. Navy XAS-2354 specification requirement for Ryder Gear Load is 3300 lbs/in. minimum. Thus, only Examples IV, V and VI meet the minimum requirement.

What is claimed is:

1. A synthetic lubricating oil composition comprising a major amount of a synthetic ester base oil stock, from about 0.01 to about 10.0 parts per 100 parts by weight of the ester base oil stock of an organo amine salt of a phosphoric acid ester selected from the group consisting of organo amine salts characterized by the formula:

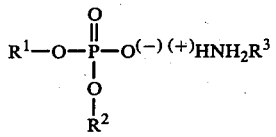

or the formula:

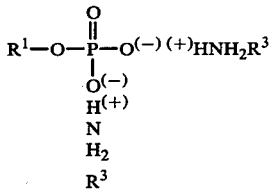

and mixtures thereof, wherein $R^1$ is an alkyl or alkenyl group containing from 1 to 10 carbon atoms, $R^2$ is either the same or a different alkyl or alkenyl group containing from 1 to 10 carbon atoms and $R^3$ is either hydrogen, an alkyl or alkenyl group containing from 1 to 22 carbon atoms or an arylalkyl group characterized by the formula:

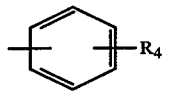

or the formula:

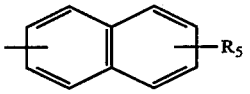

wherein $R_4$ is hydrogen, or an alkyl or alkenyl group containing from 1 to 12 carbon atoms and $R_5$ is hydrogen or an alkyl or alkenyl group containing from 1 to 6 carbon atoms; and from about 0.01 to about 5.0 parts per 100 parts by weight of the ester base oil stock of an organo sulfonic acid ammonium salt, said synthetic ester base oil stock selected from the group consisting of (a) simple esters derived from monohydric aliphatic alcohols having 1 to 18 carbon atoms and monobasic aliphatic acids having 2 to 22 carbon atoms or dibasic aliphatic acids having 2 to 25 carbon atoms, (b) complex esters formed from the reaction of two or more of the following compounds:

(i) monohydric aliphatic alcohols having 1 to 18 carbon atoms,
(ii) monobasic aliphatic acids having 2 to 22 carbon atoms,
(iii) aliphatic glycols or polyglycols having from 2 to 70 carbon atoms,
(iv) polyhydric aliphatic alcohols having 4 to 25 carbon atoms,
(v) dibasic aliphatic acids having from 2 to 22 carbon atoms, and
(iv) polybasic aliphatic acids having 3 to 30 carbon atoms, where at least one polyfunctional alcohol and at least one polyfunctional acid are employed and (c) polyesters derived from polyhydric aliphatic alcohols containing from 2 to 10 hydroxyl groups and 4 to 25 carbon atoms and monobasic aliphatic acids having from 2 to 22 carbon atoms.

2. The lubricating oil composition of claim 1 wherein said organo sulfonic acid ammonium salt includes a sulfonate group containing a hydrocarbyl group and an ammonium group of the formula $NR^1R^2R^3R^4_x$ wherein x is 0 or 1, $R^1$, $R^2$ and $R^4$ are each hydrogen or a $C_1$ to $C_{28}$ hydrocarbyl group, and $R^3$ is a $C_1$ to $C_{28}$ hydrocarbyl group.

3. The lubricating oil composition of claim 2, wherein the sulfonate group contains an alkyl group of 1 to 18 carbon atoms.

4. The lubricating oil composition of claim 2, wherein the sulfonate group contains an alkylated phenyl, naphthyl or anthranil aromatic group having at least one $C_1$ to $C_{12}$ alkyl group.

5. The lubricating oil composition of claim 2, wherein the sulfonate group contains a radical selected from the group consisting of an n-dodecylbenzene group, a methane group, a p-toluene group, a naphthalene group and a DL camphor group.

6. The lubricant composition of claim 2 wherein x is 0.

7. The lubricant composition of claim 1, wherein $R^1$ and $R^2$ are unsubstituted alkyl groups and $R^3$ is a $C_1$ to $C_{28}$ 2-hydroxy substituted alkyl group.

8. The lubricant composition of claim 2, wherein $R^2$ and $R^3$ are n-butyl groups and $R^4$ is an n-butyl group or a 2-hydroxy pentadecyl group.

9. The lubricant composition of claim 2, wherein x is 1 and $R^1$, $R^2$ and $R^4$ are ethyl groups.

10. The lubricant composition of claim 2, wherein the ammonium group is derived from a mixed branched chain isomeric 1,1-dimethyl $C_{12}$–$C_{14}$ primary aliphatic amine or a mixed branched chain isomeric 1,1-dimethyl $C_{18}$–$C_{22}$ primary amine.

11. The composition of claim 2 wherein said simple ester is derived from monohydric aliphatic alcohols having 4 to 13 carbon atoms and monobasic aliphatic acids having 4 to 12 carbon atoms or dibasic aliphatic acids having 4 to 14 carbon atoms, said complex esters are derived from the reaction of two or more of the following compounds:

(i) monohydric aliphatic alcohols having 4 to 13 carbon atoms,
(ii) monobasic aliphatic acids having 4 to 12 carbon atoms,
(iii) aliphatic glycols or polyglycols having 2 to 18 carbon atoms,
(iv) polyhydric aliphatic alcohols having 5 to 20 carbon atoms,
(v) dibasic aliphatic acids having 4 to 14 carbon atoms and
(vi) polybasic aliphatic acids having 4 to 14 carbon atoms, and said polyester is derived from polyhydric aliphatic alcohols containing from 5 to 20 carbon atoms and monobasic aliphatic acids having 4 to 12 carbon atoms.

12. The lubricant composition of claim 1, wherein the synthetic ester oil is made by esterifying a polyol having at least 3 hydroxyl groups with a monocarboxylic alkanoic acid having 5 to 10 carbon atoms.

13. The lubricant composition of claim 1, wherein the synthetic ester oil is an ester of a mono-basic aliphatic saturated fatty acid and a polyol chosen from the group consisting of tri-hydroxy polyols, tetrahydroxy polyols and dimers of said tetrahydroxy polyols.

14. The synthetic lubricating composition of claim 1, wherein said organo amine salt is present at a concentration within the range from about 0.01 to about 0.5 parts, by weight, organosulfonic acid ammonium salt is present at a concentration within the range from about 0.01 to about 0.5 parts by weight, and the base oil stock is present at a concentration of 100 parts by weight.

15. The synthetic lubricating oil composition of claim 1, further comprising at least one antioxidant selected from the group consisting of di(alkylphenyl) amines, phenyl-α-naphthylamine, phenyl-β-naphthylamine and alkylphenyl-α-naphthylamine and alkylphenyl-β naphthylamine, and mixtures thereof.

16. The synthetic lubricating oil of claim 15, wherein said lubricating oil composition comprises at least one di(alkylphenyl) amine and at least one alkylphenyl-α-naphthylamine or alkylphenyl-β-naphthylamine.

17. The synthetic oil composition of claim 15, wherein the di(alkylphenyl) amine and the alkylphenyl-α-naphthylamine or alkylphenyl-β-naphthylamine are present at concentrations within the range from about 0.25 to about 5.0 and about 0.25 to about 3.0 part by weight, respectively, per 100 parts by weight of base oil stock.

18. The synthetic lubricating oil of claim 1, further comprising amine antioxidants and a tri(alkylphenyl) ester of phosphoric acid.

19. The synthetic lubricating oil composition of claim 2, further comprising amine oxidation inhibitors, a tri-(alkylphenyl) ester of phosphoric acid, a dispersant, a hydrolytic stabilizer and a storage stabilizer.

20. The composition of claim 19, wherein said organo amine salt of a phosphoric acid ester is a mixture of such esters prepared by combining a mixture of $C_9$–$C_{13}$ alkylphenyl amines with a mixture of $C_1$–$C_4$ alkyl esters of phosphoric acid.

21. The composition of claim 20, wherein said oxidation inhibitors are a mixture of di(octylphenyl) amine and octylphenyl-β-naphthylamine.

22. The composition of claim 21, wherein the di(octylphenyl) amine and the octylphenyl-β-naphtylamine are present at concentrations within the range from about 0.25 to about 5.0 and about 0.25 to about 3.0 part, by weight, respectively, per 100 parts by weight, of base oil stock.

* * * * *